US007865107B2

(12) United States Patent
Walsh

(10) Patent No.: US 7,865,107 B2
(45) Date of Patent: Jan. 4, 2011

(54) DISCOROTRON ASSEMBLY WITH TITANIUM SHIELD WITH INTEGRATED GRID MOUNTING AND ELECTRICAL CONNECTION

(75) Inventor: James D Walsh, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 435 days.

(21) Appl. No.: 12/123,130

(22) Filed: May 19, 2008

(65) Prior Publication Data

US 2009/0285595 A1 Nov. 19, 2009

(51) Int. Cl.
*G03G 15/02* (2006.01)

(52) U.S. Cl. ..... 399/90; 399/170

(58) Field of Classification Search ..... 399/90, 399/170, 171, 172

See application file for complete search history.

(56) References Cited

U.S. PATENT DOCUMENTS 6,339,688 B1 * 1/2002 Cho et al. ..... 399/93
2002/0064396 A1 * 5/2002 Becker et al. ..... 399/170
2004/0047653 A1 * 3/2004 Chavez et al. ..... 399/170

* cited by examiner

*Primary Examiner*—Quana M Grainger
(74) *Attorney, Agent, or Firm*—Ronald E. Prass, Jr.; Prass LLP

(57) ABSTRACT

This is a titanium shield that fits into a discorotron and helps to eliminate destructive effluents. The shield conforms to the shape of the discorotron housing and has side portions that extend beyond the side portions of the discorotron housing. On this extended portion, a grid is attached over the open surface of the discorotron. The extended portions are called ears. These ears have notches to mate with apertures in the grid. The exposed ends of the ears are covered by a guard to prevent the ears from making contact with a photoreceptive surface. Below the ears are upstanding electrical contacts which when viewed from an end view form an H-like configuration with the ears.

15 Claims, 6 Drawing Sheets

DISCOROTRON ASSEMBLY WITH TITANIUM SHIELD WITH INTEGRATED GRID MOUNTING AND ELECTRICAL CONNECTION

This invention relates to electrostatic marking systems and, more specifically, to a corona charging component of these systems.

BACKGROUND

When using an electrostatic marking system, a uniform electrostatic charge is placed upon a reusable photoconductive surface. The charged photoconductive surface is then exposed to a light image of an original to selectively dissipate the charge to form a latent electrostatic image of the original on the photoreceptor. The latent image is developed by depositing finely divided marking and charged particles (toner) upon the photoreceptor surface. The charged toner is electrostatically attached to the latent electrostatic image areas to create a visible replica of the original. The toned developed image is then transferred from the photoconductor surface to a final image support material, such as paper, and the toner image is fixed thereto by heat and pressure to form a permanent copy corresponding to the original.

In a typical electrostatic system, a photoreceptor surface is generally arranged to move in an endless path through the various processing stations of the Xerographic process. The photoconductive or photoreceptor surface is generally reusable whereby the toner image is transferred to the final support material, and the surface of the photoreceptor is prepared to be used once again for another reproduction of an original. In this endless path, several stations of corona charging are traversed. In known electrostatic copy processes, as those above noted, a number of electrostatic charging devices are used at various stations around the photoreceptor drum or belt. For example, at the following station: charge, recharge, pre-transfer, transfer, detack and preclean. These charging stations may involve a single corona device or multiple corona devices. Multiple corona device systems can be of a single type or a combination of different types of corona generating devices.

Many varied charging means are used for applying an electrostatic charge to the photosensitive member such as corona generating pins (Pin Corotron), corona generating wires (Corotron) or corona generating glass coated wire (Discorotron), for some examples. These devices can also be covered with a grid to further assist in generating a more uniform charge known as Pin Scorotron, Scorotron or Discorotron, respectively. These charging devices can be used as a single device or in a multiple device configuration utilizing any combination of devices mentioned. In high quality xerographic reproduction systems, a uniform charge is the foundation for production of a high quality output print.

Generally, the structure of a discorotron uses a thin, glass-coated wire mounted in an elongated U-shaped housing between two insulating anchors called "insulators". These support the wire in the U-shaped housing in a spring tensioned manner in a singular plane. These insulators also position the wire relative to a known ground plane also known as a shield within the discorotron. The U-shaped housing can be made from aluminum and functions as the shield or can be made from plastic and is in one embodiment an elongated U-shaped structure in which case a separate shield must be provided. The corona generating electrode is typically highly conductive and when in use is placed in close approximation to the surface to be charged. Obviously, the uniform charging of a photoreceptor is necessary for the proper operation of a xerographic machine.

A by-product of corona charging devices are several gasses (most notably $NO_x$ and ozone) which are referred to in this discussion as "effluents". Effluents must be managed in today's machines for many reasons which will be discussed in this disclosure. This management is usually through some type of air extraction and filtering system. The effluents can interact with the surrounding atmosphere, which may include organic compounds like morpholine, and with the photoreceptor itself to produce substantial negative charging effects on the photoreceptor and the resulting copy. These are sometimes called lateral charge migration (LCM) and/or parking deletion. This can cause the output of a printed copy to appear blurry or have areas where the image is entirely missing or deleted.

Nitric oxide deletions and other effluents have been a pervasive and persistent problem in these electrostatic copying systems. The shield embodiments of this invention are simple and effective ways to minimize these problems.

There are presently three forms of charging devices: corotrons, scorotrons and discorotrons. All will be referred to in this disclosure as "corotrons" or a source of "corona" discharge. The charging devices use high voltages to create a corona. This corona can be thought of as a collection of ions (charged atoms or molecules) in a local area. In most cases, the corona is influenced to move towards the desired target by the opposite charge on a screen or grid-type device.

The different names of the charge device or corotrons denote different configurations. Corotrons are simply bare wires. A high DC potential is placed on the corotron to create the corona. To charge photoreceptors to a positive voltage, a large positive DC voltage is placed on the corotron wire. To charge negatively, a negative potential is placed on the wire. Discorotrons are a wire device also. In this case, the wire is coated with a thin film of dielectric glass. Discorotrons have an alternating voltage placed on them to create both positive and negative ions. A screen or grid with a DC bias directs the discorotron's charge toward the photoreceptor. The grid voltage determines the polarity and amplitude of the charge placed on the photoreceptor.

An important consideration is that there are many ways to charge photoreceptors. Some ways have a propensity for problems to occur while others have less of an issue. In relation to nitric oxide deletions, the AC devices (discorotrons) and the negative DC devices have a higher probability of deletion problems.

The charge device is the originator of the nitric oxide parking deletion (or, for sake of clarity, deletion). The deletion process begins with the production of corona in normal atmosphere. Corona is a "cloud" of charged ions. Different types of corona contain different ions, $H^+$ and $N_4^+$ are the major positive ions for both AC and DC devices. The negative ions $NO_3^-$ and $O_3^-$ (ozone) are the major ions in negative DC discharge and AC with airflow. AC devices (discorotrons) also produce the following negative ions: $O^-$, $OH^-$, $O_2^-$, $NO_2^-$, $CO_3^-$.

The ozone ($O_3$) and $NO_x$ (NO and $NO_2$) occur in relatively large amounts. These compounds are also very chemically reactive. $NO_x$ is known as Oxides of Nitrogen. While both gasses and morpholine can contribute to the deletion problem, $NO_x$ has been cited as the main culprit, hence the reference in literature and studies to "Nitric Oxide Deletion".

Recent experiments show that the $NO_x$ output from a discorotron operated at nominal voltage is entirely $NO_2$. Charge device $NO_2$ output is attributed to the presence of ozone in the charge device area. Ozone oxidizes NO to $NO_2$.

The oxidation of NO to $NO_2$ produces one photon of light at about 1200 nm. This occurs in about 20% of the oxidized $NO_2$. As the molecule decays to a stable state, a photon is emitted with the peak excitation of 1200 nm. This is the basis for a Chemilluenesence Nitric Oxide detector sometimes used in the prior art to measure effluents.

Photoreceptors have been shown to be very sensitive to nitric acid-type compounds ($HNO_3$ and $HNO_2$). The nitric acid attacks certain molecules in the transport layer of the photoreceptor rendering them too conductive. This conductivity allows any developed charge on the photoreceptor to leak to ground in the area of the attack or spread in what is sometimes (mistakenly) called lateral charge migration. Lateral charge migration is a separate issue involving the deposit of conductive salts on the photoreceptor through the interaction of corona and atmospheric contaminants, such as morpholine. In Nitric Oxide deletions, in the worst cases, areas near the acid attack appear blank on a copy because toner is not developed to the photoreceptor in those areas. In lesser extent cases, the problem manifests itself as a blurring of the image. Some volatile organic compounds, such as morpholine and organic nitrates are effluents also detrimental to the photoreceptor.

Nitric oxide deletions are often termed parking deletions. This nomenclature arises from the way in which nitric oxide deletions are most prevalent. When charging devices are run for a long period of time (during a long print run) a relatively large amount of $NO_x$ and $O_3$ (as above indicated, collectively known as effluents) are built up. The effluents become adsorbed on the surface of nearby solids. When the machine is shut down, the photoreceptor stops rotation and becomes "parked" with a small area directly adjacent to the charge device. Over a short period of time, the adsorbed effluents are released from the charge device in a process known as out gassing. Since the photoreceptor is parked in very close proximity to the charge device, a small local area of the photoreceptor becomes damaged.

The titanium shield embodiments of the present invention provide strategies employed to combat and minimize these deletions.

It is known to use titanium to help chemically reduce effluents around a photoreceptor. (By virtue of its native oxide surface layer). It is also known to use titanium dioxide ($TiO_2$) to remove nitric oxides from the environment via titanium dioxide coatings. See articles "Reactive Oxygen Species inhibited by Titanium Dioxide Coatings" (Suzuki et al.)) R. Suzuki, J. Muyco, J. McKitrrick, J. Frangos. J. Biomed. Mater. Res. A, 2003, Aug. 1 vol. 66 No. 2: pg. 396-402, and "Titanium Dioxide: Environmental White Knight", L. Frazer Environmental Health Perspectives Vol. 109, No. 4, April 2001.

SUMMARY

The embodiments of the present invention provide a novel titanium shield that fits into the housing of a discorotron. The shield has on its inboard side two raised notched ears as conductive contacts and to hold a grid in place. The shield is elongated and is coextensive with the grid and has at its bottom portion electrical contacts for connection to a high voltage source.

The discorotron that contains the shield has a typical elongated non-metallic U-shaped housing, usually plastic, with the usual wire assembly made up of a wire electrode attached at each end to anchors. The U-shaped titanium shield of the present invention fits along the length of the housing with its floor positioned below the wire assembly and its sides extending upward enclosing the wire assembly and the shield sides projecting on the inboard end beyond the sides of the discorotron housing for the purpose of mounting the grid. These projecting sides are in the form of notched ears upon which the grid is attached and secured. In an embodiment of this invention, a protective guard is placed over the upper tip of the ears to prevent the pointed ears from damaging the surface of the photoconductor when in use.

The discorotron housing has an open end at one terminal end section to provide an escape conduit for the above-discussed impurities or effluents that are formed during use and to provide means of connection to a high voltage connection. The opposite end of the discorotron housing is generally closed.

Discorotron assemblies are used to generate a more uniform electrostatic charge. To mount the grid over the high voltage wire, some inboard mounting component in the prior art would be added to the system in three or more places to hold the grid in place. Then a separate electrical contact would be added to the system to contact the grid, usually on the inboard side, thus providing some electrical potential to the grid.

The present embodiments describe a shield with an integrated grid mounting and electrical connection scheme for discorotron charge devices whose shield and grid are at the same potential. Unlike some prior art discorotrons which require three high voltage connections, the present discorotron requires just two since the grid and shield are at the same potential. The proposed integrated grid/shield assembly mates to the current high voltage connector and thereby enables the field replacement of the current discorotrons with the intended discorotrons. Advantages of the present shield include reduced production cost and improved reliability resulting from elimination of the redundant connector. The proposed shield also provides greater grid-shield and grid-wire gap consistency. A pair of stiff notched ears on the Ti shield fit into cutouts on the grid to hold the grid in place locating it the proper distance from the coronode and laterally within the device. The grid is electrified by the shield which in turn is biased from an existing connector.

This invention comprises a titanium shield with an integrated mounting feature for the grid, thus also providing the necessary electrical connection to the grid. The inboard end of the titanium shield has two extending ears that protrude slightly above the dicor housing. These two protrusions have small notches large enough to hold the grid in place. With the shield and grid both being conductive, this mounting point also provides the electrical contact. This approach is especially useful in devices where the shield and grid operate at the same electrical potential.

DETAILED DISCUSSION OF DRAWINGS AND PREFERRED EMBODIMENTS

Figure 1:
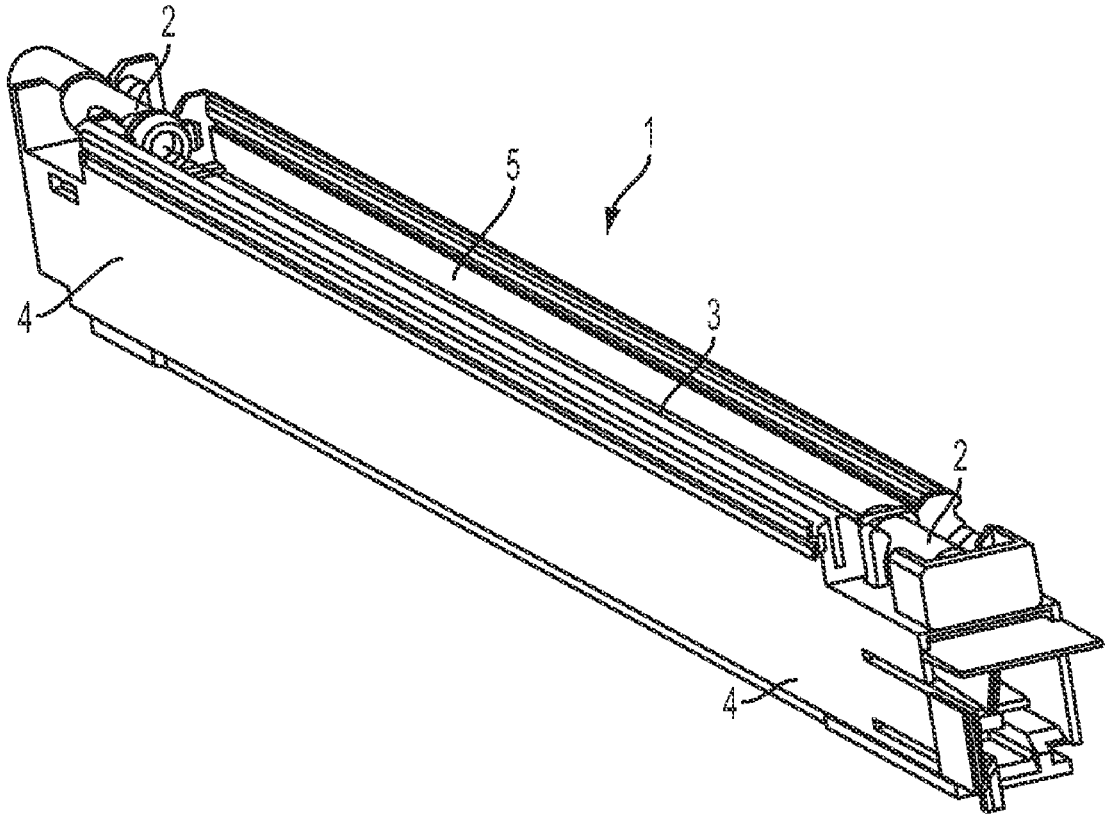
FIG. 1 PRIOR ART
FIG. 1 is a typical prior art dicorotron device.

In FIG. 1, a typical prior art dicorotron 1 is shown having a wire assembly made up of two anchors 2 and attached to these anchors 2 is a wire electrode 3. The dicorotron has a dicorotron housing 4 which is an elongated U-shaped housing 4. In side view, this housing 4 is the wire assembly made up of the wire electrode 3 and anchors 2. Generally, the dicorotron open face 5 when in use will be adjacent the photoreceptor to be charged by the wire electrode 3 and any grid (see FIG. 3).

Figure 2:
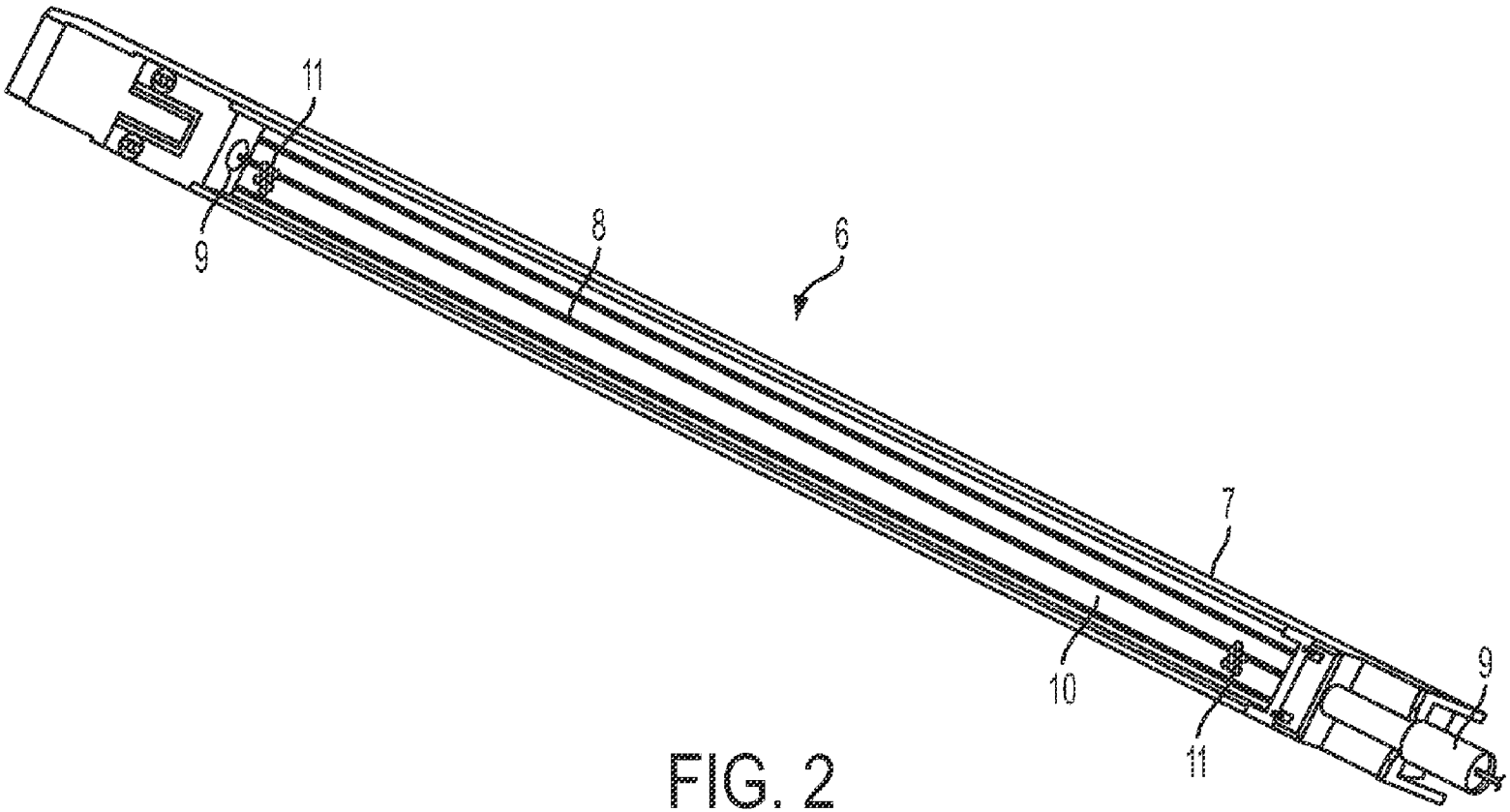
FIG. 2 is a top view of a discorotron device including the shield of this invention.

In FIG. 2, a top view of a discorotron in an embodiment of the present invention is shown. The discorotron 6 has a discorotron housing 7 which is an elongated housing having a U-shaped cross section. Inside this housing 7 is a wire assembly made up of a wire electrode 8 attached at each end to anchors 9. In this embodiment, the open housing face 10 is covered by a conductive grid 11. When in use the grid 11 is adjacent the photoreceptor to be charged. For clarity, only small portions of the grid 11 are shown, being understood that the grid 11 covers substantially the entire open face 10 of discorotron 6. The discorotron 6 has an inboard side 12 and an outboard side 13 as shown in FIG. 3.

Figure 3:
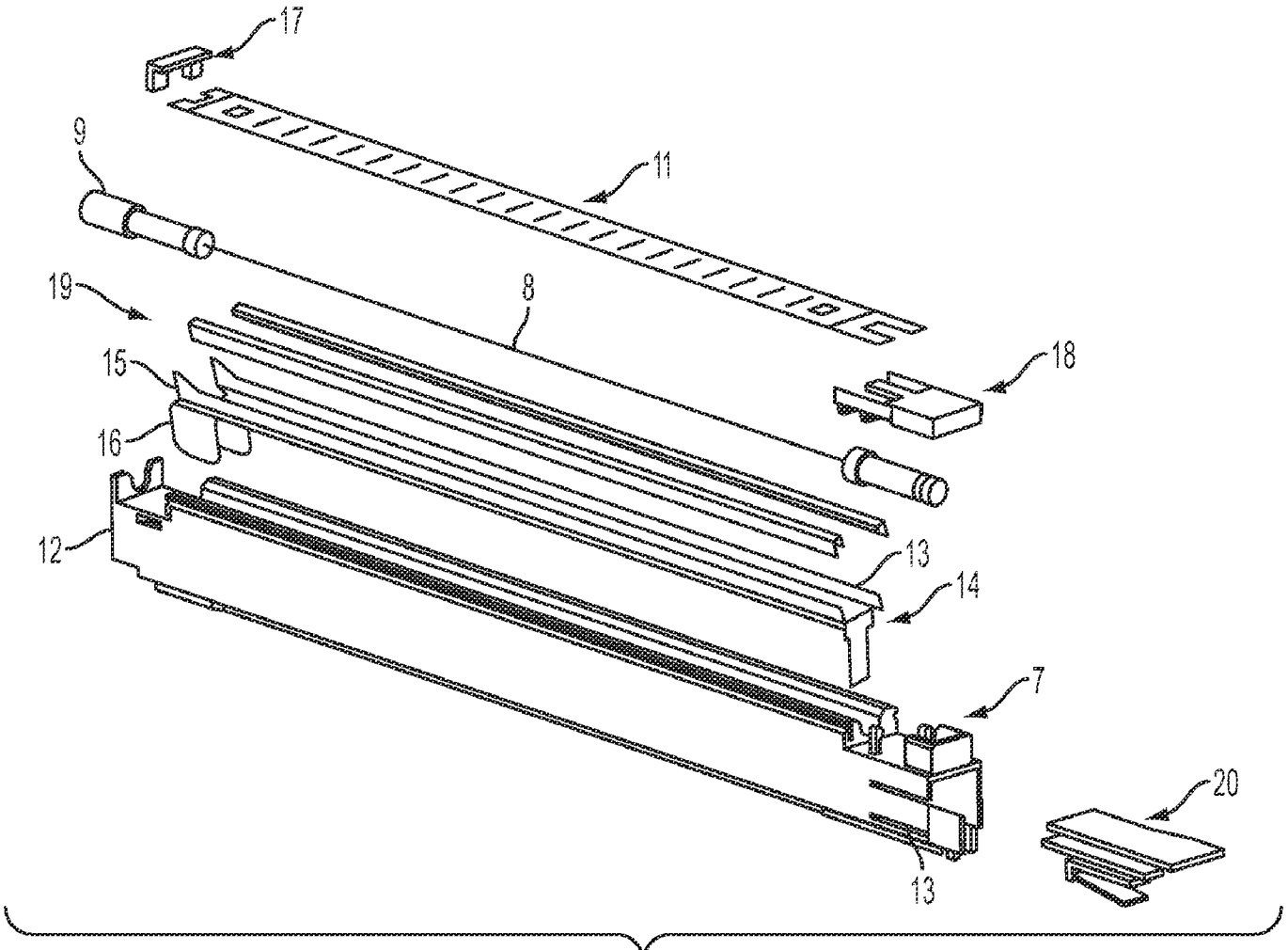
FIG. 3 is an exploded view of the discorotron of this invention including the components of the present discorotron.

In FIG. 3, an exploded view of an embodiment of the discorotron 6 of this invention is shown. The discorotron housing 7 is used to support and position all parts of the assembly components and provides the air chamber on its inboard side 12 for the removal of ozone and other effluents and gases. The titanium shield 14 of this invention is shown having projecting ears 15 and the electrical contacts 16 located at the bottom portion of shield 14. A grid 11 provides the pattern and bias to defuse and even the charge on the photoreceptor (not shown). The ears 15 are shown extending out from the inboard side 12 of the housing and the shield 14. While it is highly preferred for best results that these ears 15 be on the inboard side, these ears 15 may be on either the inboard side 12 or outboard 13 sides of the housing or shield 14, if suitable. Below the ears 15 are positioned electrical contacts 16 for connection to a high voltage connector. An inboard guard 17 is used to protect the photoreceptor from hitting the ears 15 of the shield 14. An outboard bridge 18 tensions and positions the grid 11 on the discorotron. As earlier noted, the wire assembly (anchors 9 and wire electrode 8) produce the corona field when driven with high voltage. Edge shields 19 (preferred) help position the grid 11 and reduce the gap between the grid 11 and the housing 7. Air blocker 20 plugs the outboard end 13 of the discorotron 6 to prevent air leaks and provides features to position a discorotron removal tool (not shown).

Figure 4:
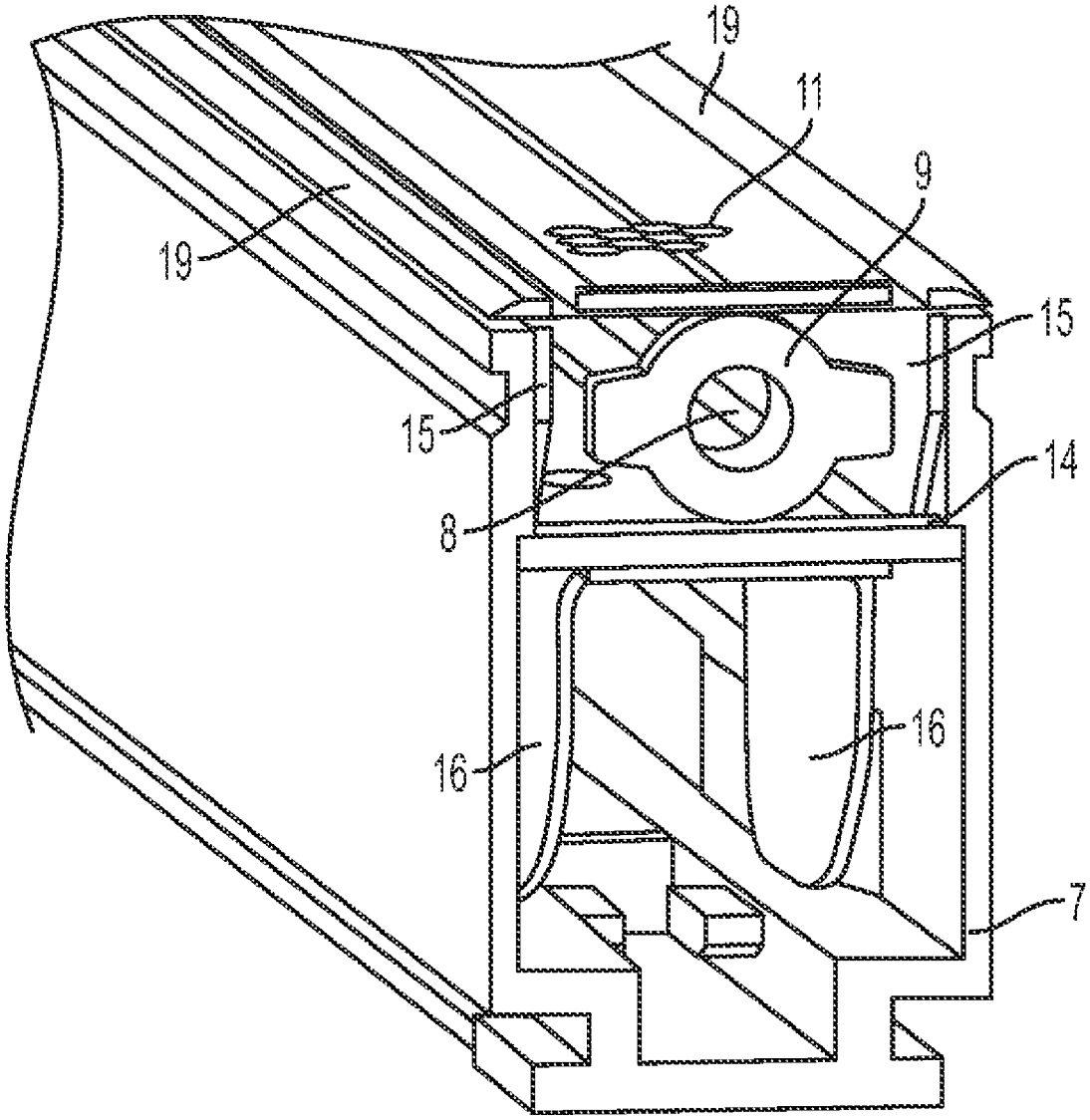
FIG. 4 is a sectioned rear view of the inboard portion of an embodiment of the discorotron of this invention.

In FIG. 4, the shield 14 is shown in position in an end perspective view of the inboard side of the shield 14 and housing 7. The shield 14 has a U-shaped elongated configuration with projecting ears 15. The end portions of conductive grid 11 have apertures through which the notched ears 15 fit and hold the grid 11 in place. As earlier noted, grid 11 extends across the entire open face 10 of discorotron housing 7 but for clarity grid 11 is shown in over a small portion of the open face 10 in FIG. 4. The end portions of the ears 15 extend above the sides of discorotron housing 7.

Figure 5:
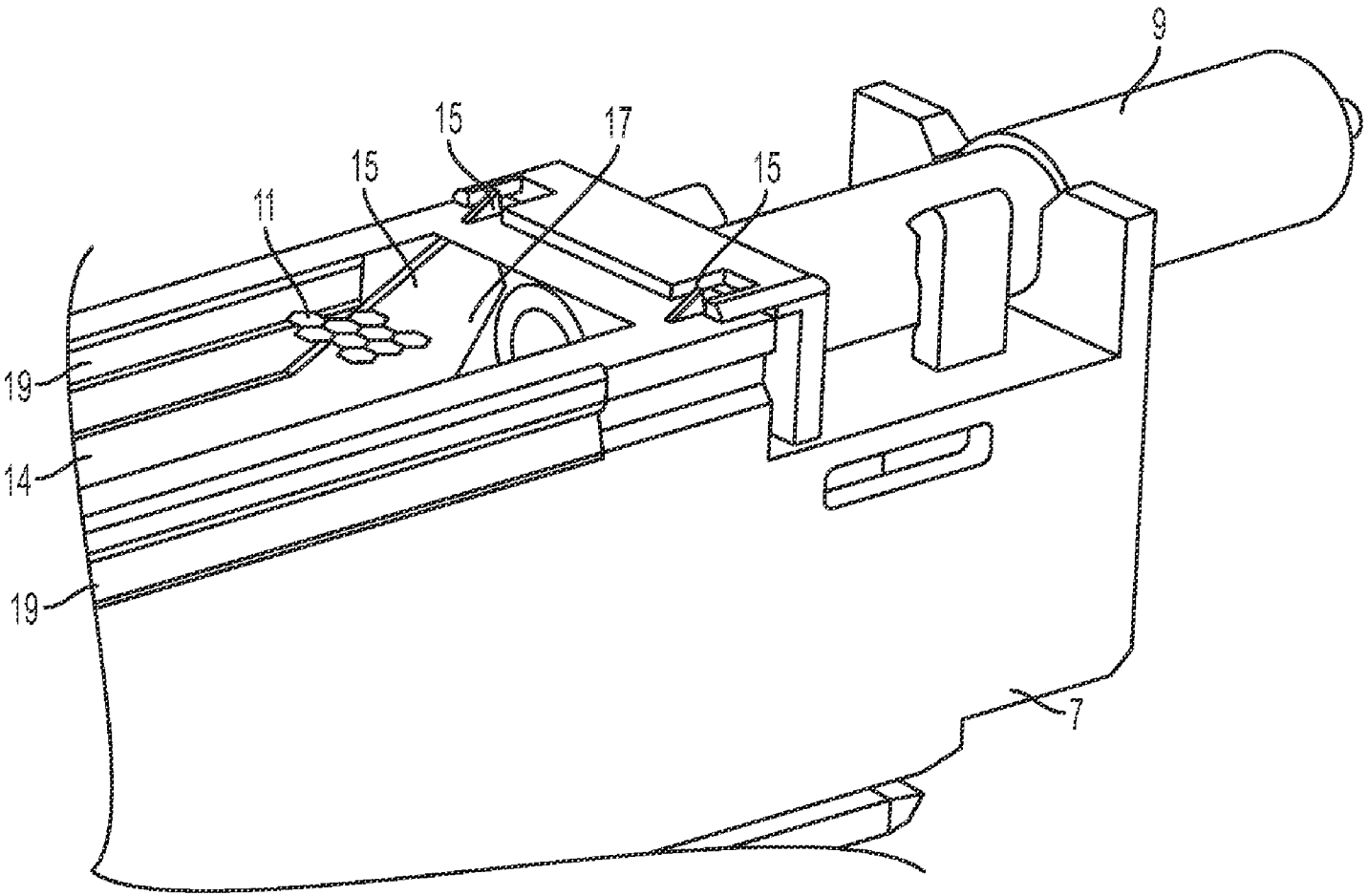
FIG. 5 is a perspective view of the inboard end of an embodiment of the discorotron and shield of this invention.

In FIG. 5, a close-up view of the inboard side 12 of the discorotron housing 7 is shown. The guard 17 is shown covering the ends of ears 15 to prevent damage to the photoreceptor when in use. The grid 11 is shown partially over the open face 10 of the discorotron. Again, the grid 11 extends over the entire open face 10; FIG. 5 only shows a partial grid 11 for clarity. The shield 14 of this invention is shown as it fits along the entire length of housing 7 and positions the inboard end of the grid 11. Also, at the inboard end of the housing 7 and below the titanium shield 14 is located the electrical contacts 16 shown in FIG. 6.

Figure 6:
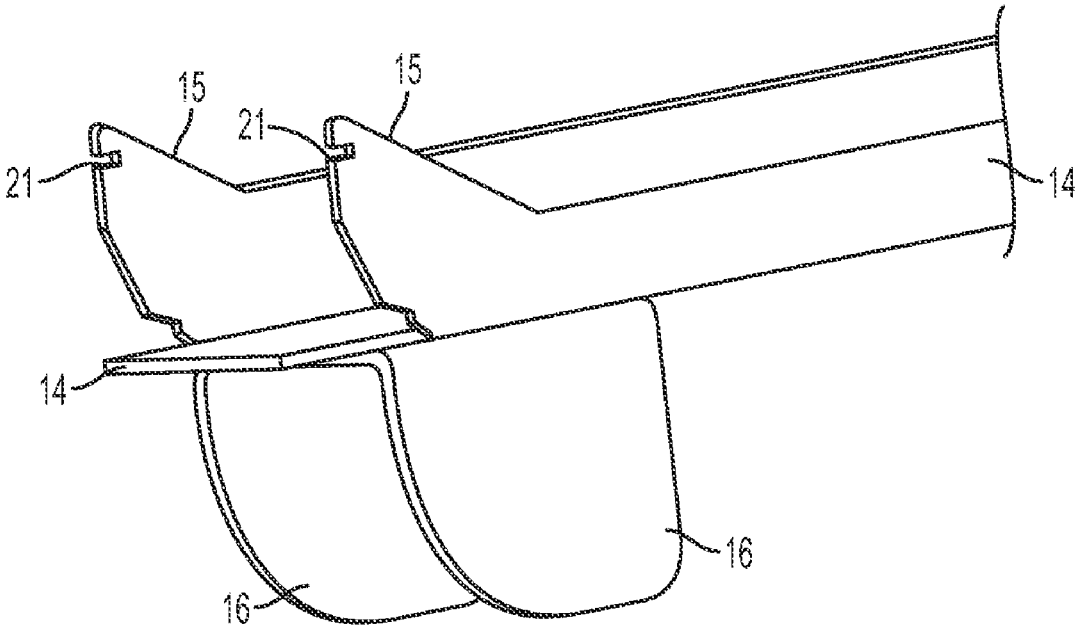
FIG. 6 is a close-up view of the electrical contact of the bottom portion of the shield of this invention.

Also shown in FIG. 6 is the inboard end of the titanium shield 14 with the rising ears 15 with notched portions 21 to mate with and hold the grid 11 in place. The electrical contacts 16 are located below the ears 15 and provide the shield 14 with electrical contact to a high voltage connector and to apply bias to the shield 14. The electrical contacts 16 are located below the ears 15 and form with the ears an H-like cross-sectional configuration.

In summary, embodiments of the present invention provide a discorotron device comprising a non-metallic elongated U-shaped housing, a wire assembly comprising two anchors holding a wire electrode there between, a titanium shield co-extensive with the housing and fitting inside the housing, and a grid over the housing and configured to direct a charge toward a photoreceptor surface when in use.

The shield comprise at its inboard end portion thereof rising ears with notches configured to hold the grid in place. The shield also comprises on its bottom portion and below the ears at least two electrical contacts configured to provide and contact a high voltage connection to the discorotron.

In this discorotron, the ears and the electrical contacts are located at an inboard portion of the shield and the grid has apertures configured to receive and mate with the notches in the ears. The electrical contacts for the discorotron are located below the ears and form with the ears an H-like cross-sectional configuration when viewed from an end view. The wire assembly of the discorotron is located between the grid and a floor of the shield. The ears extend upwardly beyond side portions of the housing and are configured to leave space to receive and hold the grid in place.

A guard is positioned over projecting end portions of the ears. This guard is enabled to avoid damaging contact of the ears and a photoreceptor surface when in use.

The discorotron has in an inboard end portion thereof an open section to provide for escape of effluents and in an air block on an outboard end to prevent discorotron air leaks and provide structures to position a discorotron removal tool.

This novel shield has a grid over its upper surface and comprises an elongated shield structure of titanium having a U-shaped cross-sectional configuration with two upstanding sides. The shield is co-extensive with the grid and configured to fit into a housing for the discorotron. The shield has an open end in its upper section. The shield has on its inboard upstanding side end portion thereof a pair of projecting notched ears. These ears are configured to protrude above and beyond the upstanding sides. The ears are adapted to provide connections to the grid and to hold the grid in place. Positioned below the ears are electrical contacts to a voltage source.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A discorotron device comprising:

a non-metallic elongated U-shaped housing, a wire assembly comprising two anchors holding a wire electrode there between, a titanium shield co-extensive with said housing and fitting inside said housing, and a grid over said housing and configured to direct a charge toward a photoreceptor surface when in use, said shield comprising on at its inboard end portion thereof rising ears with notches configured to hold said grid in place, said shield comprising on its bottom portion and below said ears at least two electrical contacts configured to provide and contact a high voltage connection to said discorotron.

2. The device of claim 1 wherein both said ears and said electrical contacts are located at an inboard portion of said shield.

3. The device of claim 1 wherein said grid has apertures configured to receive and mate with said notches in said ears.

4. The device of claim 1 wherein said electrical contacts are located below said ears and form with said ears an H-like cross-sectional configuration when viewed from an end view.

5. The device of claim 1 wherein said wire assembly is located between said grid and a floor of said shield.

6. The device of claim 1 wherein said ears extend upwardly beyond side portions of said housing and are configured to receive and hold said grid in place.

7. The device of claim 1 wherein a guard is positioned over projecting end portions of said ears, said guard enabled to avoid damaging contact of said ears and a photoreceptor surface when in use.

8. The device of claim 1 having on an inboard end portion thereof an open section to provide for escape of effluents.

9. The device of claim 1 having an air block on an outboard end to prevent discorotron air leaks and provide structures to position a discorotron removal tool.

10. A shield for use in a discorotron charge device that has a grid over its upper surface said shield comprising:

an elongated shield structure of titanium having a U-shaped cross-sectional configuration with two upstanding sides, said shield co-extensive with said grid and configured to fit into a housing for said device, said shield having an open end in its upper section, said shield having on at its inboard end of said upstanding side portion thereof a pair of projecting notched ears, said ears, configured to protrude above and beyond said upstanding sides, said ears adapted to both provide connections to said grid and to hold said grid in place, positioned below said ears are electrical contacts to a voltage source.

11. The shield of claim 10 wherein said ears and said electrical contacts are located on an inboard portion of said shield.

12. The shield of claim 10 wherein said notched ears are configured to mate with and hold said grid in place.

13. The shield of claim 10 wherein said electrical contacts are located below said ears and form with said ears an H-like cross-sectional configuration when viewed from an end view.

14. The shield of claim 10 having a floor and two side portions, said floor configured to be located below a wire assembly in a discorotron device.

15. The shield of claim 10 having a guard to fit over said projecting ears, said guard configured to prevent said projecting ears from damaging a surface in contact therewith.

* * * * *